US005982339A

United States Patent [19]

Lalezari et al.

[11] Patent Number: 5,982,339

[45] **Date of Patent: *Nov. 9, 1999**

[54] ANTENNA SYSTEM UTILIZING A FREQUENCY SELECTIVE SURFACE

[75] Inventors: Farzin Lalezari, Louisville; Paul A. Zidek, Lafayette, both of Colo.

[73] Assignee: Ball Aerospace & Technologies Corp., Boulder, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/756,767

[22] Filed: Nov. 26, 1996

[51] Int. Cl.[6] ..... H01Q 5/00

[52] U.S. Cl. ..... 343/872; 343/705; 343/909

[58] Field of Search ..... 343/700 MS, 725, 343/909, 815, 795, 705, 708, 872, 765; H01Q 5/00, 21/00, 15/02, 15/24

[56] References Cited

U.S. PATENT DOCUMENTS

| | | | |
|---|---|---|---|
| 3,148,370 | 9/1964 | Bowman | 343/756 |
| 4,126,866 | 11/1978 | Pelton | 343/909 |
| 4,864,314 | 9/1989 | Bond | 343/725 |
| 4,926,189 | 5/1990 | Zaghloul et al. | 343/700 MS |
| 5,001,493 | 3/1991 | Patin et al. | 343/700 MS |
| 5,160,936 | 11/1992 | Braun et al. | 343/700 MS |
| 5,395,718 | 3/1995 | Jensen et al. | 430/5 |
| 5,485,167 | 1/1996 | Wong et al. | 343/815 |
| 5,528,249 | 6/1996 | Gafford et al. | 343/700 MS |

*Primary Examiner*—Michael C. Wimer
*Attorney, Agent, or Firm*—Sheridan Ross P.C.

[57] ABSTRACT

An antenna element is provided that includes a frequency selective surface (FSS) portion on its primary radiating/receiving surface. The antenna element is conductively or capacitively coupled to an RF feed structure that can also include an FSS portion. In a preferred embodiment, the FSS antenna portion is located at least partially within the radiation pattern of a second antenna that operates in a frequency range for which the FSS is substantially transparent. In this way, signals being transferred to or from the second antenna through space can travel through the FSS antenna portion with little attenuation and/or reflection.

5 Claims, 10 Drawing Sheets

VIEW I-I

ANTENNA SYSTEM UTILIZING A FREQUENCY SELECTIVE SURFACE

FIELD OF THE INVENTION

The invention relates in general to antenna structures for transmitting and receiving radio frequency energy and, more particularly, to an antenna structure that utilizes a frequency selective surface.

BACKGROUND OF THE INVENTION

Applications involving the transmission of radio frequency (RF) energy (such as, for example, microwave or millimeter wave energy) through free space are abundant. For example, radar systems, satellite communications systems, aircraft altimeter and guidance systems, and ground reconnaissance mapping systems all involve the transmission of RF energy through space. To implement such systems, antennas must be provided for radiating and/or receiving the RF energy to/from free space. In this regard, the antenna acts as a transition between a wave guiding structure (i.e., a transmission line) internal to the system and free space. Many different types of antennas exist, each having its own advantages and disadvantages.

In many systems, both commercial and military, multiple applications involving the transmission of RF energy are practiced. For example, commercial aircraft generally include both weather radar units and ground communications systems. In such systems, at least one antenna is required to perform each application. A problem arises when limited surface space (i.e, real estate) is available for the antennas, such as is generally the case with aircraft. In general, it is difficult to implement multiple antennas in close proximity to one another because of interference and crosstalk concerns.

Therefore, a need exists for a method and apparatus for implementing multiple antennas within a limited space without incurring negative interference effects. Also, a need exists for a method and apparatus for increasing the number of antennas that may be implemented within a given space.

SUMMARY OF THE INVENTION

The present invention relates to an antenna system that includes an antenna element having a frequency selective surface (FSS) portion on its main radiating and/or receiving surface. An FSS is a structure that is relatively transparent to radio frequency energy in a first frequency range while being reflective/conductive of radio frequency energy in other frequency ranges. In accordance with the invention, the FSS antenna portion can be implemented at least partially within the operational radiation pattern of a second antenna, operating in the first frequency range, without creating undesirable reflections or attenuation of signals being transferred between the second antenna and free space. The FSS antenna is driven by a conductively or capacitively coupled feed that, in one embodiment, also comprises an FSS portion. The invention is particularly suited for use in systems that require multiple antennas to be implemented in a limited amount of space, but is also of value in systems that utilize only a single antenna element.

In one aspect of the present invention, an antenna system is provided that includes: (a) an antenna element capable of transmitting and receiving radio frequency energy to/from free space; (b) a transmission line for transferring radio frequency energy to/from signal processing circuitry; and (c) a feed structure, located between the antenna element and the transmission line, for coupling radio frequency energy between the antenna element and the transmission line, wherein the feed structure is coupled to the antenna element using one of the following coupling arrangements: conductive coupling and capacitive coupling; wherein at least one of the antenna element and the feed structure includes a frequency selective surface portion that is predominantly conductive to radio frequency energy in a first frequency range and is predominantly transmissive to radio frequency energy in a second, non-overlapping frequency range.

The transmission line is generally operative for delivering a transmit signal to the antenna from a transmitter unit or for delivering a receive signal to a receiver unit from the antenna. In this regard, the transmission line can include virtually any type of signal guiding structure, such as a microstrip or stripline transmission line, a coaxial cable, a twisted pair, a coplanar or parallel plate waveguide, a circular or rectangular waveguide, or other signal guiding structure. The antenna element can include any type of structure that is capable of radiating/receiving radio frequency energy into/from free space. This can include, for example, a dipole antenna, a patch antenna, a loop antenna, an aperture antenna, and others. It should be appreciated that, as used herein, the phrase "free space" relates to any propagation of energy in space (e.g., in the atmosphere) that is substantially unobstructed over at least a portion of its travel path.

The feed structure can include any structure for transitioning a radio frequency signal between a transmission line and an antenna element. In general, the feed structure will include impedance matching means for matching the characteristic impedance of the transmission line to the antenna input impedance. In a preferred embodiment, the feed structure includes a split twin lead transmission structure having a tapered line width for matching purposes.

In accordance with the invention, either the antenna element or the feed structure, or both, can include a portion having FSS properties, as described above. The FSS portion can be defined by, for example, a repetitive pattern of conductive material disposed upon a dielectric substrate. In one embodiment of the invention, the entire antenna element is constructed of an FSS.

In another aspect of the present invention, an antenna system is provided that includes: (a) an antenna element capable of transmitting and receiving radio frequency energy in a first frequency range to/from free space; and (b) a feed structure for use in transferring radio frequency energy in the first frequency range between the antenna element and signal processing circuitry; wherein both the antenna element and the feed structure are comprised of a frequency selective surface that is predominantly conductive to radio frequency energy in the first frequency range and predominantly transmissive to radio frequency energy in a second, non-overlapping frequency range, so that the antenna system produces less reflection when impinged upon by a radio frequency signal in the second frequency range that the antenna system would if it did not comprise a frequency selective surface. The system can also include support means comprising a frequency selective surface for providing structural support to the antenna element and/or the feed structure. In one embodiment, the entire antenna system is substantially transparent to radio frequency energy in the second frequency range.

In yet another embodiment of the present invention, a multiple frequency antenna system is provided. The system includes: (a) a first antenna element, operative in a first frequency range, capable of transmitting radio frequency energy in the first frequency range to and receiving radio frequency energy in the first frequency range from free space; (b) a first feed unit for use in transferring radio frequency energy in the first frequency range between the first antenna element and first signal processing circuitry; (c) a second antenna element located near the first antenna element and operative in a second, non-overlapping frequency range, the second antenna element comprising a frequency selective surface portion that is predominantly transmissive to radio frequency energy in the first frequency range; and (d) a second feed unit for use in transferring radio frequency energy in the second frequency range between the second antenna element and second signal processing circuitry, wherein the second feed unit is coupled to the second antenna element using one of the following coupling arrangements: conductive coupling and capacitive coupling; wherein radio frequency energy in the first frequency range transferred between the first antenna element and free space travels through the frequency selective surface portion of the second antenna element.

The first antenna element can include or be a part of virtually any type of radiating/receiving means capable of operating in the first frequency range, such as, for example, a dipole, slot, patch, spiral, monopole, horn, reflector, helix, doorstop, Vivaldi, notch, and/or array antenna. The second antenna element can include any type of radiating/receiving element capable of operating in the second frequency range in conjunction with a conductively or capacitively coupled feed, and also capable of being formed, at least in part, of an FSS. This can include, for example, a dipole, patch, spiral, monopole, horn, helix, doorstop, Vivaldi, and/or notch antenna element. The second antenna element can also be a part of an array of elements acting cooperatively. As described above, the second feed unit is conductively or capacitively coupled to the second antenna element so that signals can be transferred between the two elements. This is in contrast to a radiative feed arrangement (such as a space feed) that delivers RF energy to an antenna element (such as, e.g., a reflector) via radiated waves.

In addition to the second antenna element, the feed structure can also comprise a frequency selective surface. Thus, the feed structure can also be placed in the signal path between the first antenna element and free space. The FSS can be part of a waveguiding structure within the feed, for example.

In still another aspect of the present invention, another multiple frequency antenna system is provided. The system includes: (a) a first antenna capable of transmitting/receiving radio frequency energy in a first frequency range; (b) a radome for use in covering the first antenna, the radome comprising a dielectric material that is predominantly transmissive to radio frequency energy in the first frequency range so that a radio frequency signal in the first frequency range travelling between the first antenna and an exterior environment travels through the radome; and (c) a second antenna that is capable of transmitting/ receiving radio frequency energy in a second, non-overlapping frequency range and being defined by a frequency selective surface portion that is predominantly transmissive to radio frequency energy in the first frequency range, wherein at least a portion of the radio frequency signal travelling between the first antenna and the exterior environment travels through the frequency selective surface portion. The frequency selective surface is as described above.

The radome can comprise any type of covering for the first antenna that is predominantly transmissive of RF energy in the first frequency range. The radome material can be physically separate from the first antenna or in contact therewith. In one embodiment, the radome comprises the nosecone of an aircraft. The second antenna includes an FSS portion that is predominantly transmissive to energy in the first frequency range. Therefore, energy transmitted by the first antenna travels through the FSS portion with relatively little reflection/absorption. The second antenna can be, for example, disposed upon an inner or outer surface of the radome, can be located within the wall of the radome, or can be internally or externally suspended from the radome or from another structure.

DETAILED DESCRIPTION

The present invention relates to an antenna system that utilizes a frequency selective surface (FSS) as a radiating and/or receiving surface. That is, during a transmit mode, a radio frequency signal from a signal source is delivered to the FSS (via a feed structure) and is thereafter radiated from the FSS into free spaces Similarly, during a receive mode, a radio frequency signal propagating in free space is picked up by the FSS which then delivers the signal to signal processing circuitry via the feed structure. The FSS is substantially transparent to radio frequency energy in a predetermined frequency band and, therefore, can be placed in proximity to a second antenna that is operating in the predetermined frequency band without interfering substantially with the operation of the second antenna. This allows multiple antennas to occupy a space that previously could only be used by a single antenna. In this regard, the invention is particularly useful in systems that have little available real estate, such as in aircraft and satellite applications.

Figure 1:
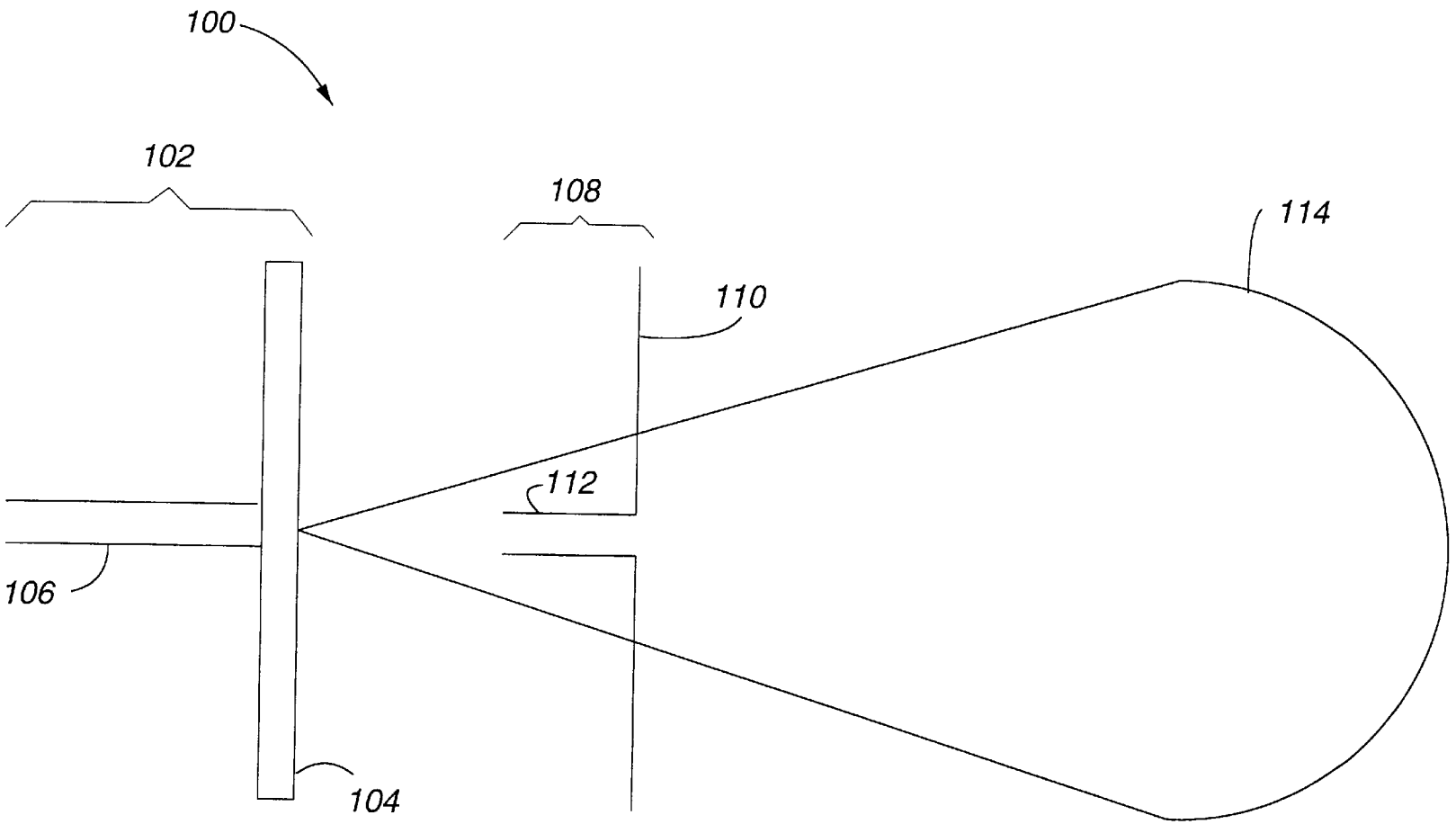
FIG. 1 is a schematic diagram of an antenna system illustrating, in simplified form, an embodiment of the present invention.
Figure 2:
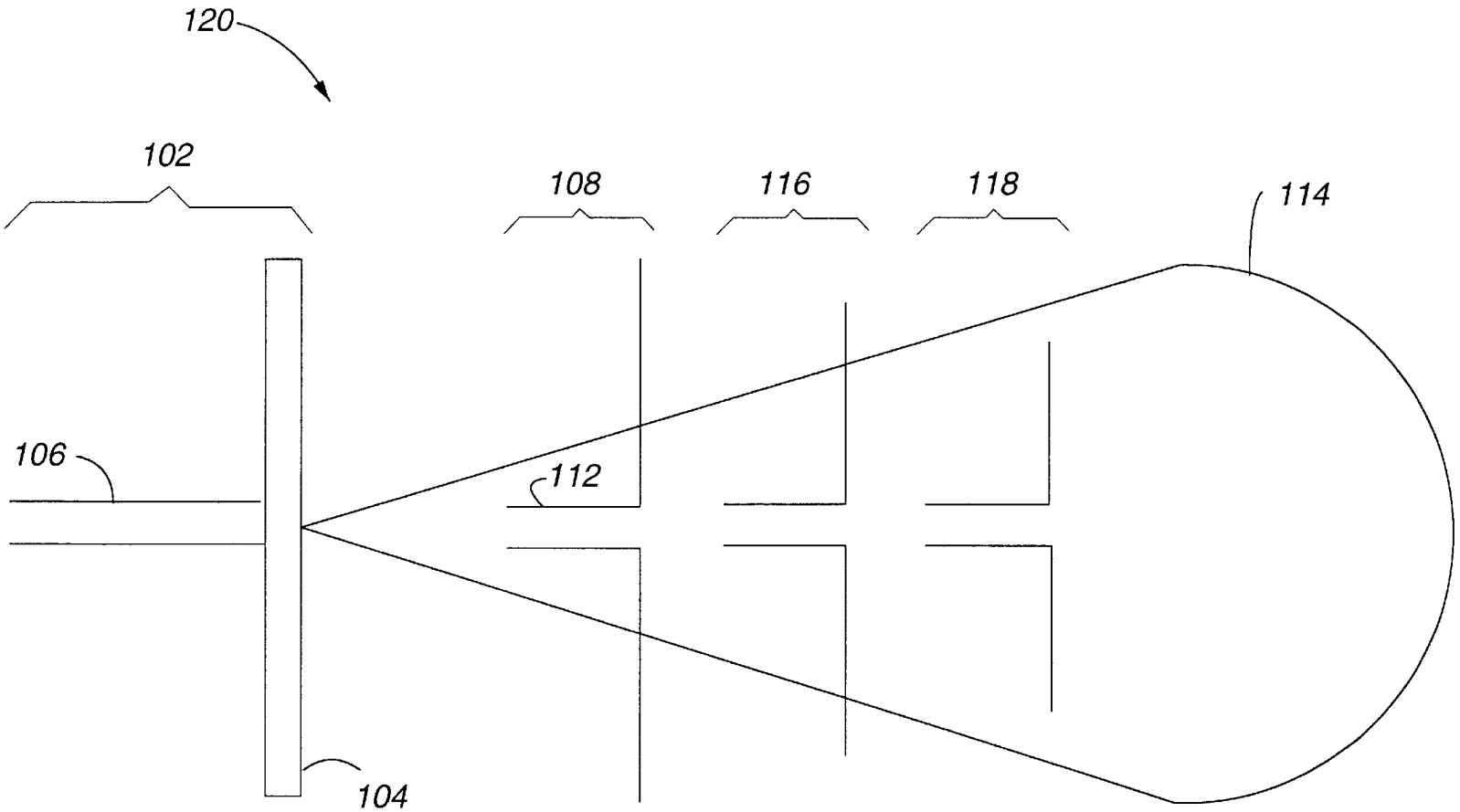
FIG. 2 is a schematic diagram of an antenna system illustrating, in simplified form, another embodiment of the present invention.

FIG. 1 is a schematic diagram of an antenna system 100 illustrating, in simplified form, an embodiment of the present invention. As shown, the system 100 includes a primary antenna 102 having a first antenna element 104 and a feed structure 106 operative in a first frequency range, and a secondary antenna 108 having a second antenna element 110 and a feed structure 112 operative in a second frequency range. The secondary antenna 108 is located at least partially within the operational radiation pattern 114 of the primary antenna 102. The operational radiation pattern 114 can represent, for example, the half-power radiation region for the primary antenna 102. In accordance with the present invention, the secondary antenna 108 is comprised of an FSS that is substantially transparent in the first frequency range. In this way, a signal transmitted from or travelling to the primary antenna 102 travels through the secondary antenna 108 with minimal reflection or crosstalk. FIG. 2 illustrates a system 120 having three secondary FSS antennas 108, 116, 118, each operative for transmission/reception in a different frequency range, located within the radiation region 114 of the primary antenna 102. In this system 120, the secondary antennas 116 and 118 need to be transparent in multiple operational frequency ranges. For example, secondary antenna 118 must include an FSS that is transparent to radio frequency energy in the operational frequency ranges of the primary antenna 102 and the secondary antennas 108 and 116.

Figure 3:
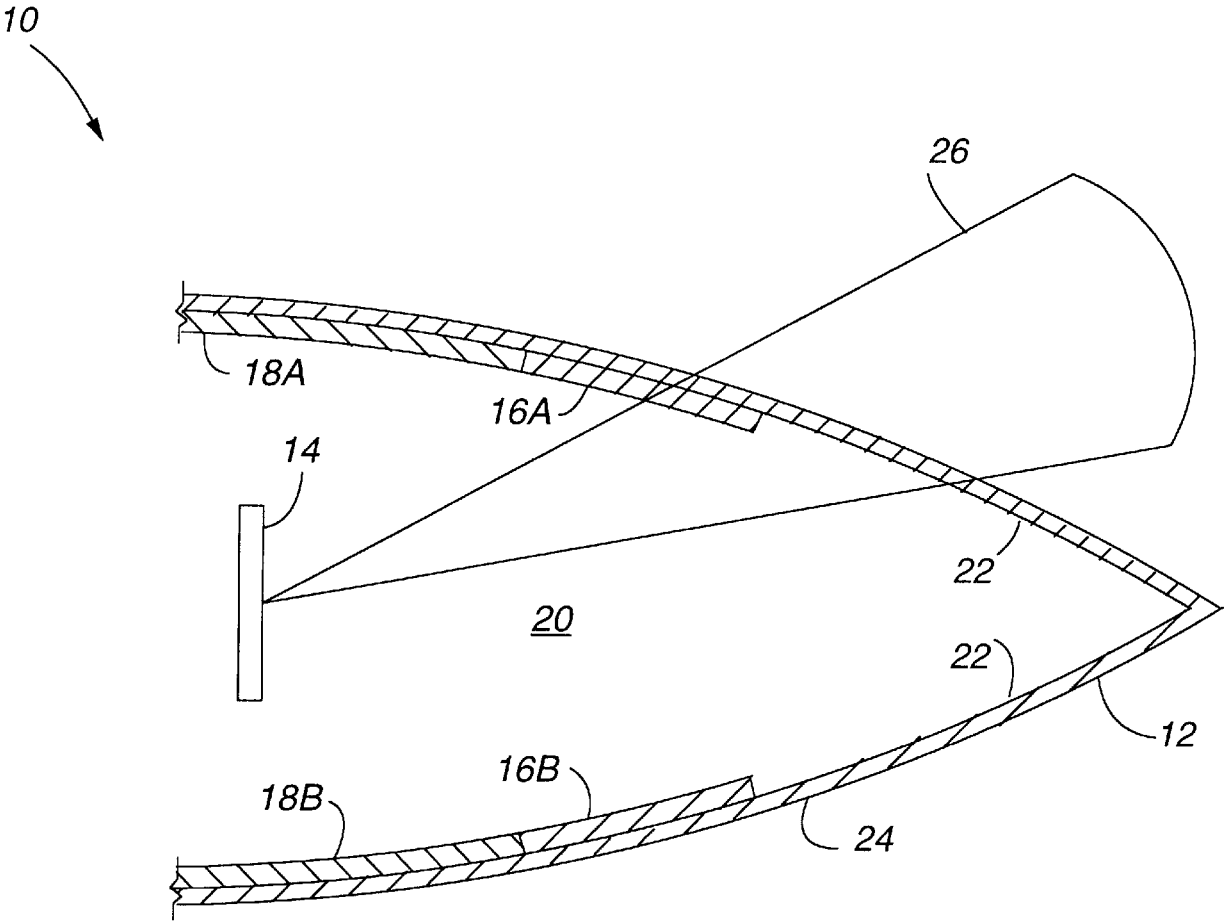
FIG. 3 is a sectional view of an antenna system in accordance with one embodiment of the present invention.

FIG. 3 illustrates an antenna system 10 in accordance with one embodiment of the present invention. As illustrated, the antenna system 10 is implemented in the nosecone of an aircraft, that also acts as a radome 12 for the antenna system 10. The antenna system 10 also includes: a primary antenna 14 capable of transmitting and/or receiving radio frequency energy in a first frequency range, one or more secondary antennas 16A, 16B capable of transmitting and/or receiving radio frequency energy in a second frequency range, and one or more feed structures 18A, 18B for feeding the secondary antennas 16A, 16B. The radome 12 is comprised of a dielectric material, such as an epoxy fiberglass, that has the required structural and aerodynamic qualities to act as a nosecone and that is substantially transparent to radio frequency energy in at least the first frequency range.

In general, the primary antenna 14 and the secondary antennas 16A, 16B in antenna system 10 perform separate functions within the aircraft. For example, in one embodiment, the primary antenna 14 is part of a weather radar system and the secondary antennas 16A, 16B are used for communications. Because multiple antenna applications can be practiced in the nosecone of the aircraft in accordance with the present invention, costly antenna carrying "blades" can be dispensed with. In the past, these blades were usually used to provide communications antennas for the aircraft and were normally mounted on the fuselage of the aircraft. In this regard, the blades caused a significant amount of drag for the aircraft. Therefore, dispensing with the blades can increase aircraft performance and fuel economy. It should be appreciated, that both the primary antenna 14 and the secondary antennas 16A, 16B can be used for any airborne antenna application including, for example, navigation, altimetry, electronic warfare, global positioning, targeting, tracking, and others.

The primary antenna 14 is centrally disposed within the radome 12 and may comprise virtually any type of antenna that can fit into the interior portion 20 of the radome 12. In this regard, the primary antenna 14 can include a phased array antenna, a horn antenna, a patch antenna, a dish antenna, a dipole antenna, or others. In addition, the primary antenna 14 can be gimbaled or held in a fixed position. The specific type of antenna used as the primary antenna 14 depends upon the application being performed, size and weight concerns, and cost.

In a preferred embodiment of the present invention, the secondary antennas 16A, 16B are disposed on or within the radome 12. That is, the secondary antennas 16A, 16B can be disposed on an interior surface 22 of the radome 12, an exterior surface 24 of the radome 12, or within the wall of the radome 12. Alternatively, the secondary antennas 16A, 16B can be suspended within the interior portion 20 of the radome 12. If the secondary antennas 16A, 16B are located within the wall of or inside of the radome 12, the dielectric material comprising the radome 12 must be substantially transparent (i.e., low loss) to RF energy in the second frequency range as well as the first frequency range. Unlike the primary antenna 14 and for reasons that will soon become apparent, the secondary antennas 16A, 16B are generally limited to substantially flat antenna types, such as phased arrays, patches, and dipoles having microstrip radiating elements.

The secondary antennas 16A, 16B, are fed by conductively or capacitively coupled feeds 18A, 18B that, in a preferred embodiment, are mounted similarly to the secondary antennas 16A, 16B. That is, if the secondary antennas are mounted on the inside surface 22 of the radome 12, the feeds 18A, 18B are also mounted on the interior surface 22, as illustrated in FIG. 3. The feeds 18A, 18B facilitate the transfer of RF signals between the secondary antennas 16A, 16B and electronic circuitry (not shown) within another portion of the aircraft. In this regard, the feeds 18A, 18B act as, among other things, impedance matching devices between the secondary antennas 16A, 16B and transmission lines leading to the electronic circuitry. The electronic circuitry can include, for example, transmit and/or receive circuitry and signal processing circuitry.

Figure 4:
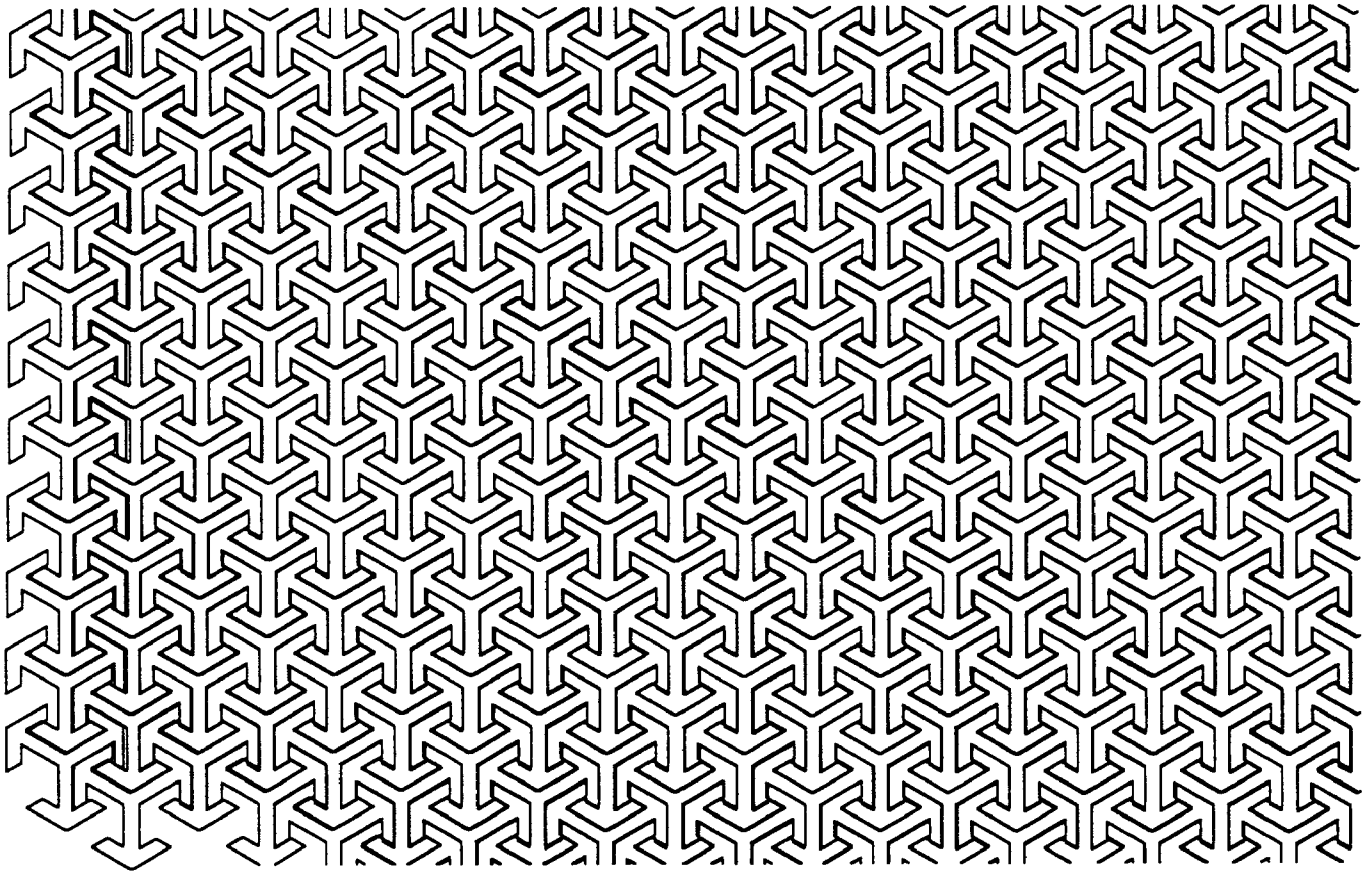
FIG. 4 illustrates an FSS pattern in accordance with one embodiment of the present invention.

In accordance with the present invention, the secondary antennas 16A, 16B are defined by a frequency selective surface (FSS). An FSS generally comprises any structure that displays quasi-bandpass or quasi-bandreject filter characteristics to radio frequency signals impinging upon the surface from any one of a continuum of predetermined angles. That is, an FSS is a structure that passes signals having frequencies within a first frequency range while reflecting/conducting signals having frequencies within a second frequency range. One type of FSS that is particularly suited for use with the present invention comprises a repetitive metallization pattern that is, in most cases, disposed upon the surface of a dielectric material (although it is also possible to utilize a rigid metallization pattern that is not associated with a substrate). FIG. 4 illustrates such a pattern, wherein the black lines represent the metallization. As can be seen, the pattern provides a series of interconnected filtration "elements" that form a single conductive unit (i.e., there is dc electrical continuity across the entire pattern). The pattern that is chosen for any particular application is based upon the center frequency and bandwidth of the signals to be passed and/or rejected by the FSS. Methods for designing such surfaces are well known and, therefore, will not be discussed further.

As seen in FIG. 3, because the secondary antenna 16A is comprised of an FSS that is substantially transparent to RF energy in the first frequency range, signals transmitted from the primary antenna 14 in the first frequency range pass through the secondary antenna 16A with little or no reflection or absorption. In one embodiment of the present invention, each feed 18A, 18B is also comprised of an FSS that passes RF signals in the first frequency range. When used as a feed, the FSS is operating as a signal guiding means in the second frequency range.

It should be appreciated that the present invention is not limited to use with antennas in only two frequency ranges.

That is, three or more antennas, each operative in a different frequency range, can be implemented in a limited area using the principles of the present invention.

Figure 5A:
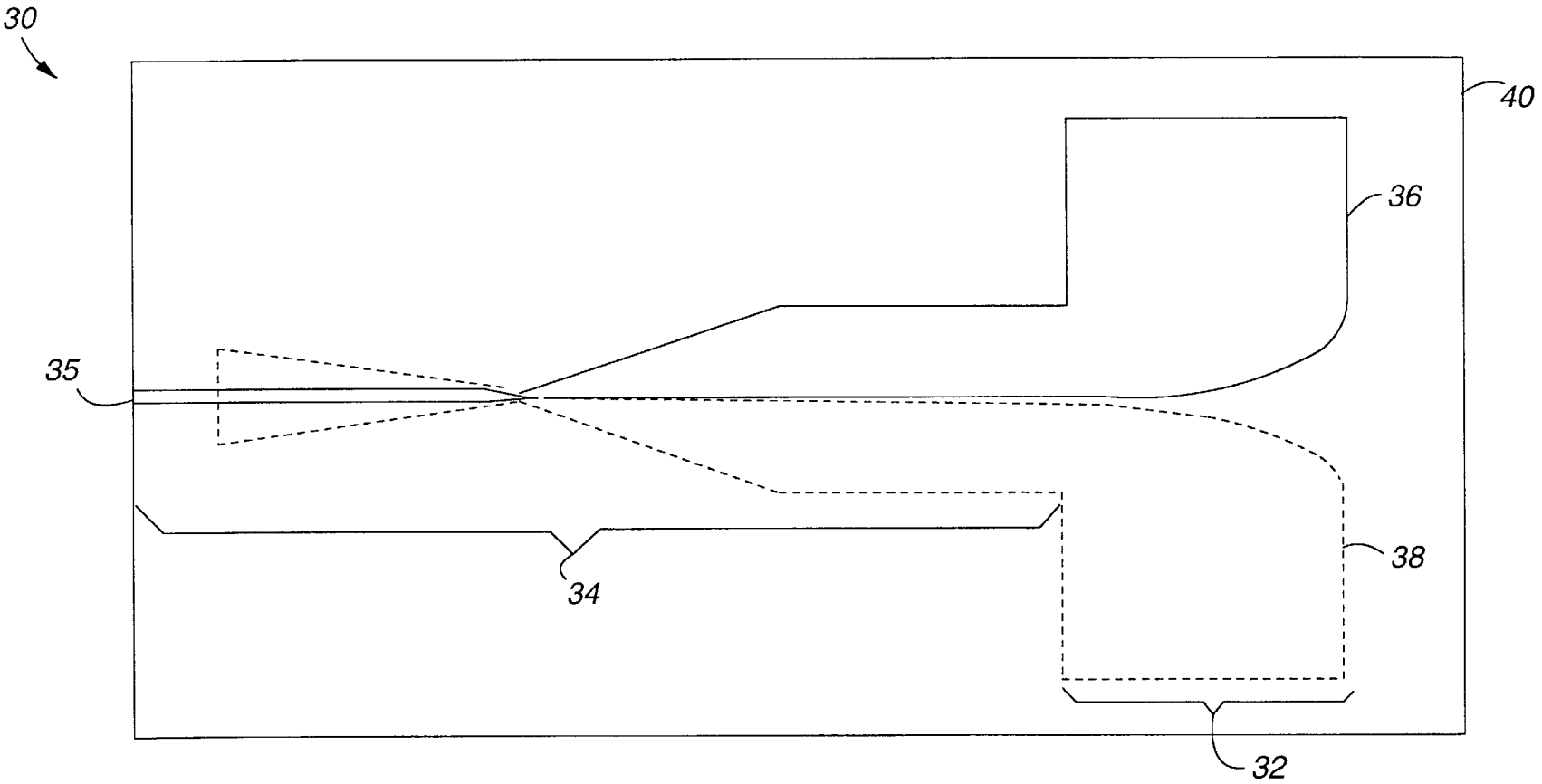
FIGS. 5A and 5B are a top view and a side view, respectively, illustrating an antenna/feed arrangement in accordance with one embodiment of the present invention.
Figure 5B:
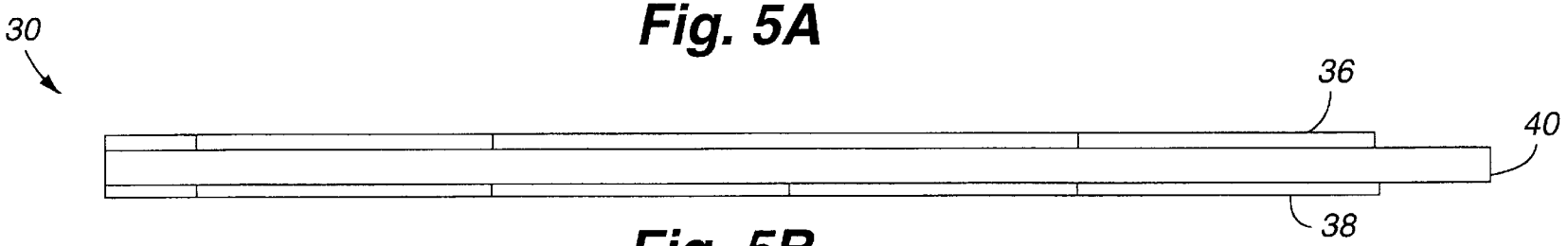

FIGS. 5A and 5B flare a top view and a side view, respectively, of a flared dipole antenna/feed 30 that is used as a secondary antenna and feed in one embodiment of the present invention. The flared dipole antenna/feed 30 includes a dipole antenna element 32 and a feed portion 34. The feed portion 34 is operative for, among other things, receiving an RF transmit signal from a transmitter (not shown), at an input/output port 35, and delivering the transmit signal to the antenna element 32 for transmission into free space. The feed portion 34 is also operative for receiving an RF receive signal from the antenna element 32 and transferring the receive signal to receiver circuitry (not shown) via the input/output port 35. Duplexing means (not shown), coupled to input/output port 35, is provided for steering the transmit and receive signals from/to the proper locations. It should be appreciated that the antenna/feed 30 of FIGS. 5A and 5B does not have to be used as both a transmit and receive antenna and can be used solely for transmitting or solely for receiving in accordance with the present invention.

The feed portion 34 of the flared dipole antenna/feed 30 comprises a split twin lead transmission structure. Use of a split twin lead structure rather than, for example, a coplanar structure was found to be advantageous because the wide transmission line can be made transparent in a certain frequency range without edge discontinuities that cause increased blockage in that frequency range. The feed portion 34 also provides impedance matching structures for reducing signal reflections at the input/output port 35.

Figure 6A:
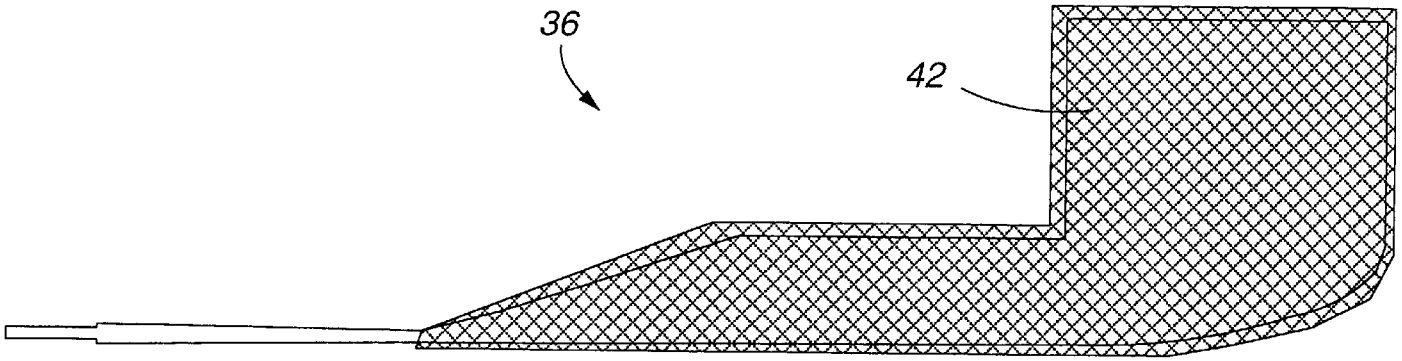
FIGS. 6A and 6B illustrate antenna/feed metallization regions having FSS portions in accordance with one embodiment of the present invention.
Figure 6B:
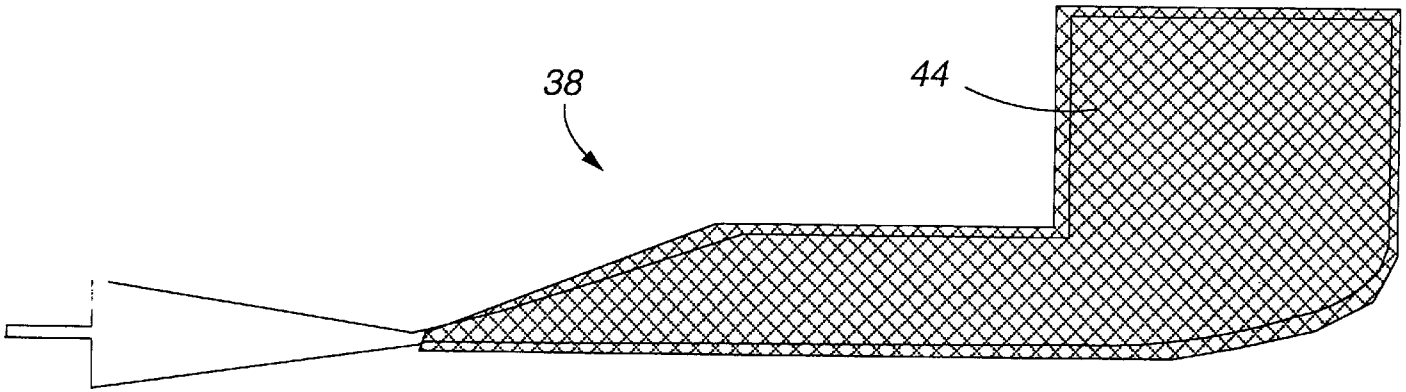

The flared dipole antenna/feed 30 includes two metallization regions 36, 38 disposed on opposite sides of a substrate material 40. In accordance with the present invention, the two metallization regions 36, 38 are each at least partially comprised of an FSS metallization pattern. FIGS. 6A and 6B are front views of each of the metallization regions 36, 38 showing the FSS portions 42, 44. In general, because the FSS pattern provides electrical continuity across the entire surface, the FSS portions 42, 44 operate substantially the same as solid metallization regions in certain frequency ranges. The circuit dimensions of the FSS portions 42, 44, however, are slightly different than the theoretical values for solid metallization patterns and, therefore, an extra design step must be performed to determine the proper dimensions of the FSS portions 42, 44. In general, well known modeling and measurement techniques are utilized to determine these proper dimensions. Once the proper dimensions have been determined, the FSS portions 42, 44 may be created using well known masking techniques such as photolithography.

In a preferred embodiment, the substrate material 40 of the flared dipole antenna/feed 30 is a relatively thin, flexible dielectric sheet that allows the antenna to be conformally arranged with respect to the wall of the radome 12. In another embodiment, the wall of the radome 12 acts as the substrate material 40 with one of the metallization regions 36, 38 on the inside surface 22 and the other on the outside surface 24.

Figure 7:
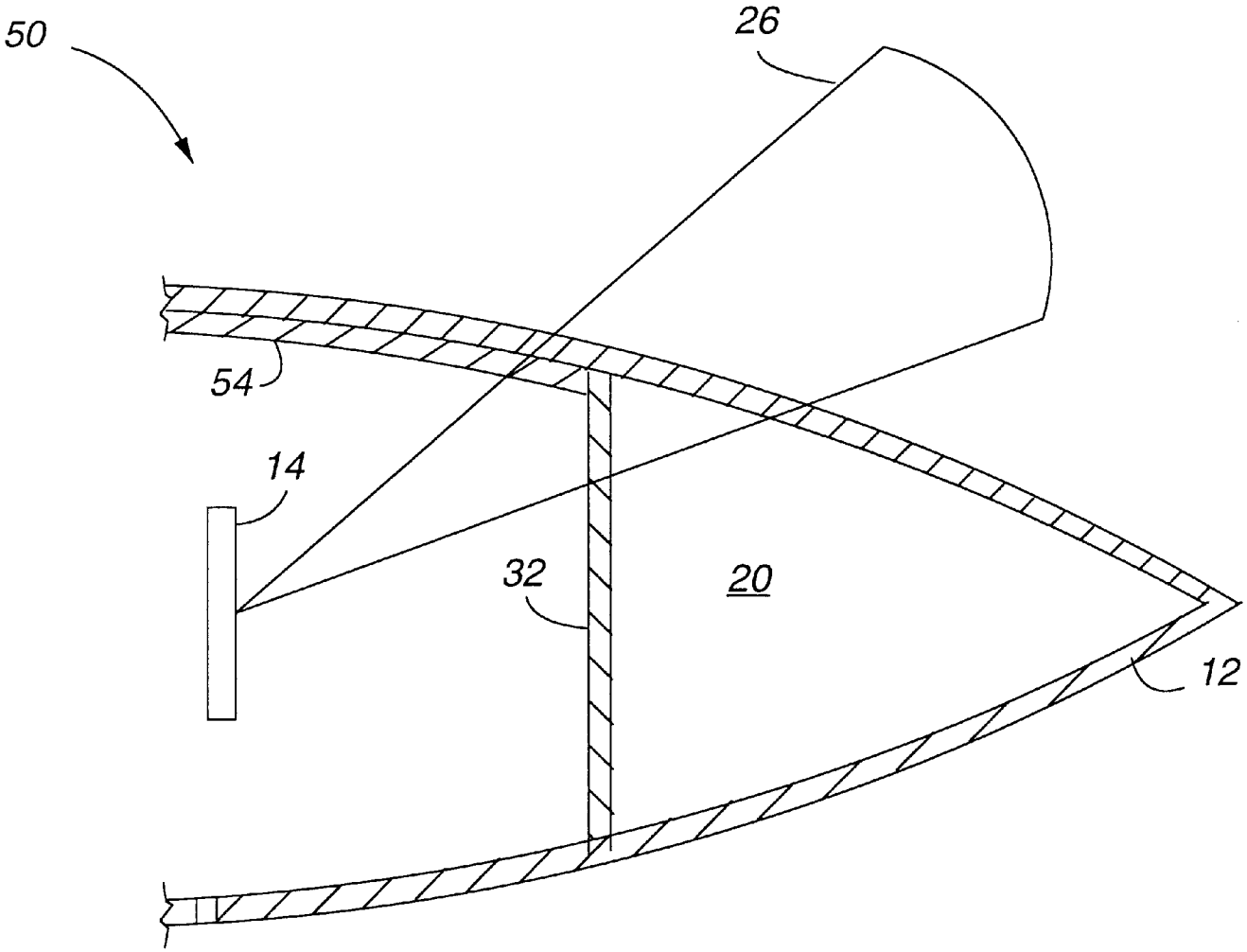
FIG. 7 is a sectional view illustrating an antenna system in accordance with another embodiment of the present invention.

FIG. 7 illustrates an antenna system 50 in accordance with another aspect of the present invention. The antenna system 50 is also implemented in the nosecone of an aircraft. The system 50 includes: a radome 12, a primary antenna 14, a secondary antenna 52, and a feed structure 54. The secondary antenna 52 in system 50 is mounted vertically within the interior portion 20 of the radome 12. In a preferred embodiment, the secondary antenna 52 is a phased array antenna, wherein each element in the array is driven by a separate input signal from feed 54. Each element in the phased array comprises an FSS that is transparent to RF energy in the frequency of operation of the primary antenna 14. In addition, the feed structure 54 can comprise an FSS. As in the system 10 of FIG. 3, the secondary antenna 52 is generally limited to substantially flat antenna types, such as phased arrays, patches, and dipoles having microstrip radiating elements.

In the past, FSSs have been used to cover the entire surface of an aircraft radome/nosecone so that only selected RF signals are allowed to enter the radome and all other RF signals are scattered. This technique reduces the possibility of interference between stray or undesired signals in the air and internal avionics equipment. In addition, the technique significantly reduces the radar cross section of the front end of the aircraft for military applications. None of these past systems, however, have utilized an FSS as an antenna element for radiating and/or receiving RF signals in conjunction with a conductively or capacitively coupled feed. In one embodiment of the present invention, the radome 12 is fully covered with the FSS except for portions where the secondary antennas are being implemented.

Figure 8A:
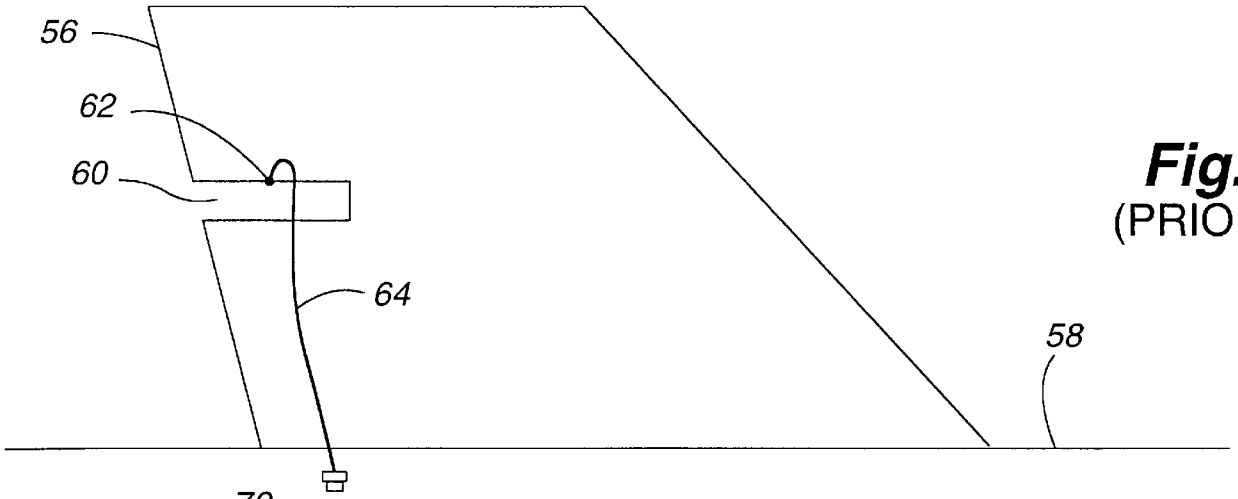
Fig. 8A (PRIOR ART)
FIG. 8A is a side view illustrating an aircraft blade antenna system of the prior art.

In another embodiment of the present invention, the FSS is used to increase the number of antenna applications that may be implemented on a single aircraft "blade". FIG. 8A illustrates a typical blade 56 of the prior art which is only capable of performing a single antenna application. The blade 56 is attached to the fuselage 58 of an aircraft an is shaped to provide favorable aerodynamic qualities. In addition, the blade 56 is covered with a solid conductive material for achieving the desired antenna properties. The blade 56 includes a notch 60 having a feed point 61. An RF feed 64 feeds an RF transmit signal to the feed point 61, causing the blade 56 to radiate RF energy in a desired antenna pattern. Blades such as blade 56 are generally used for communications applications.

Figure 8B:
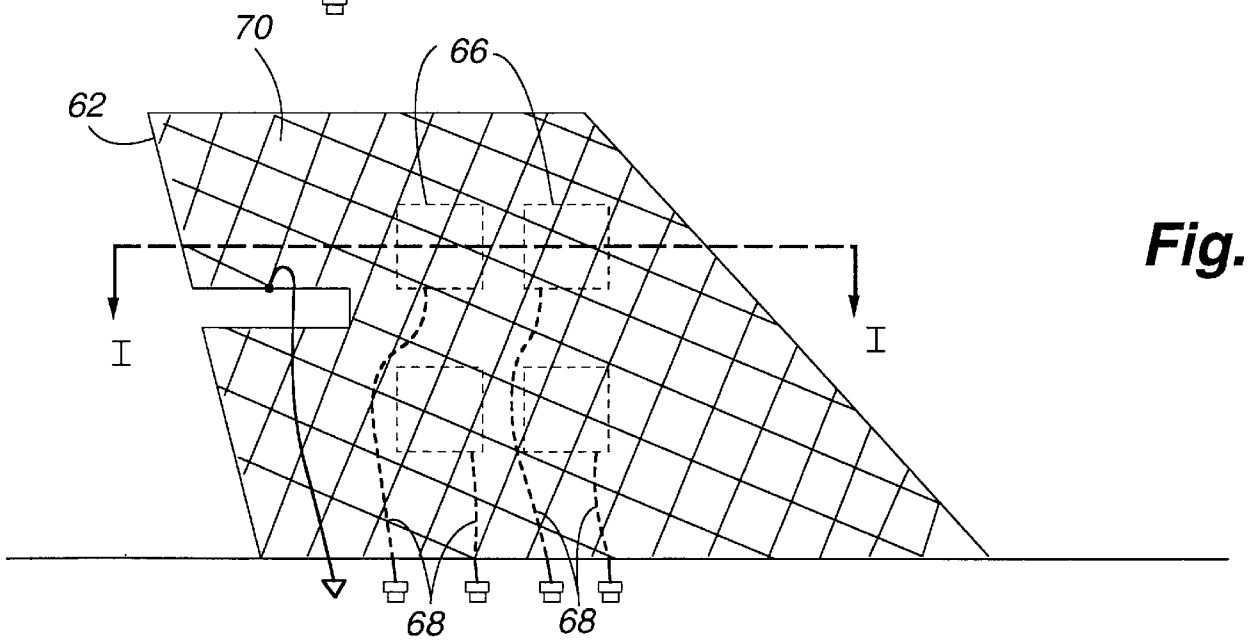
FIG. 8B is a side view illustrating an aircraft blade antenna system in accordance with the present invention.

FIG. 8B illustrates a blade 62 in accordance with one embodiment of the present invention. The blade 62 is of the same general shape as the prior art blade 56, but instead of being covered with a solid conductive material, the blade 62 is covered with an FSS pattern 70 (represented in FIG. 8B as a crosshatch pattern). Mounted inside the blade 62 are one or more other antennas 66, and associated feeds 68, that are capable of operating in a frequency range for which the FSS pattern 70 is substantially transparent.

Figure 9:
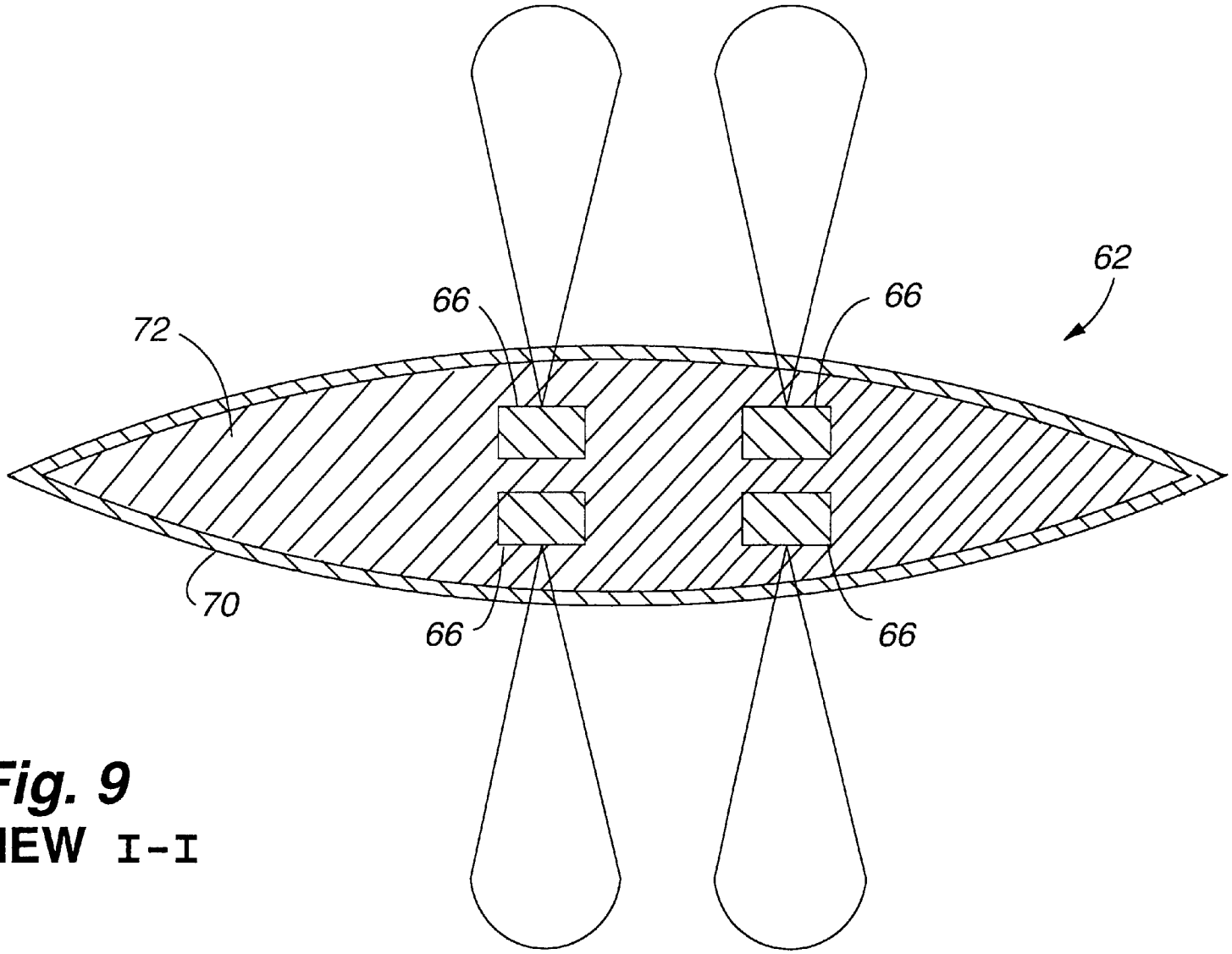
FIG. 9 is a sectional view of the antenna system of FIG. 6B.

FIG. 9 is a sectional view of the blade 62 of FIG. 8B. As illustrated in FIG. 9, a structural dielectric material 72, that is substantially transparent in the same frequency range as the FSS, is also located within the blade 62 for providing structural integrity to the blade 62 and for supporting the secondary antennas 66. The dielectric material 72 can be solid or porous. Also, other structural/support elements (not shown) can be located within the blade 62 as long as they do not interfere with RF signals being transmitted/received by the other antennas 66. The other antennas 66 can include any type of antenna that is capable of fitting into the interior portion of the blade 62. The other antennas 66 can each be unidirectional, as illustrated in FIG. 9, or bidirectional.

Figure 10:
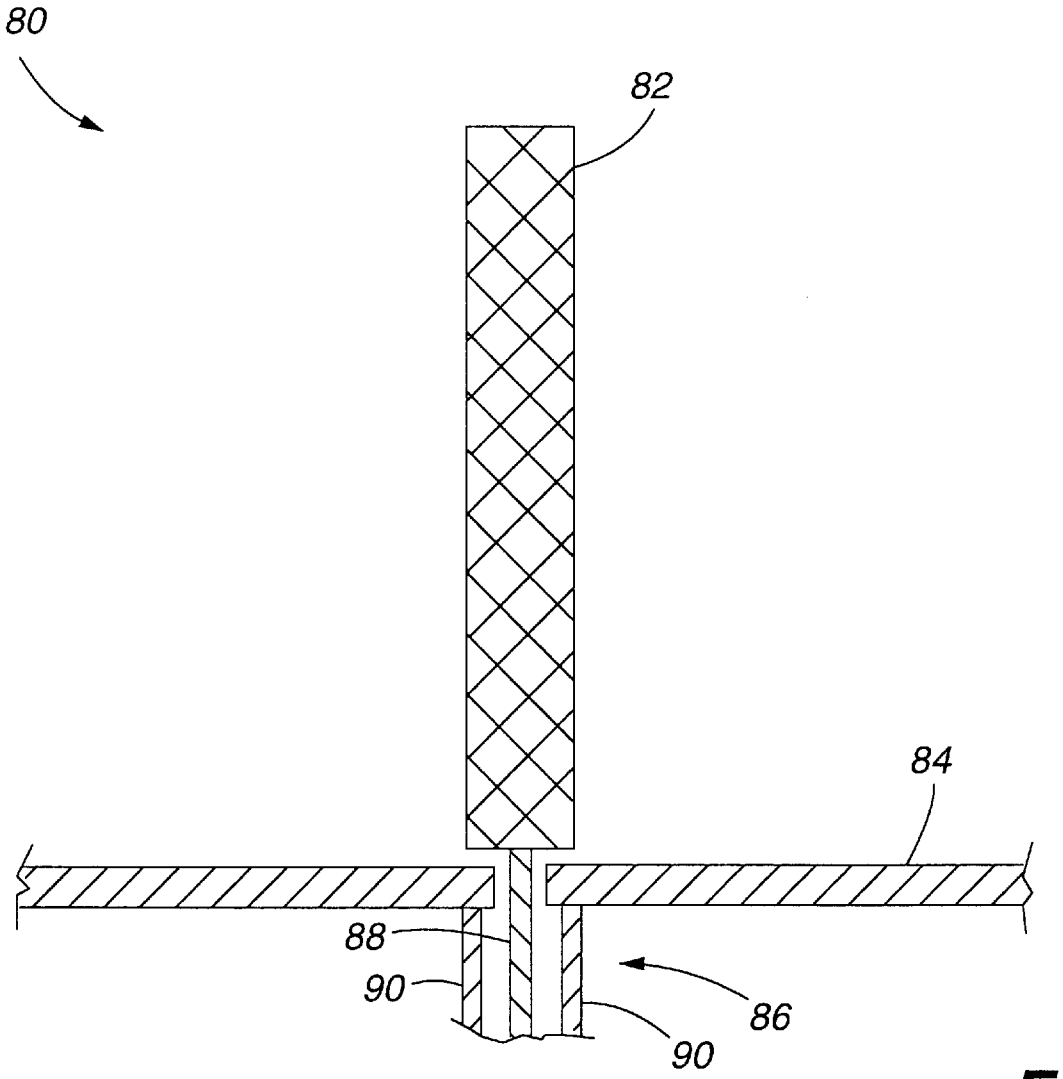
FIG. 10 is a sectional view illustrating a monopole antenna in accordance with the present invention.

The present invention is not limited to use on aircraft or space vehicles but can also be used in terrestrial applications. For example, FIG. 10 illustrates an embodiment of the present invention that can be used to replace the monopole antenna on military ground vehicles and tanks. In the prior art, relatively long (i.e., about 6 feet) monopole antennas having relatively large radar cross sections were mounted on military vehicles for communications purposes. Because of the large radar cross section, the prior art antennas were easily detected by enemy radar systems. In accordance with the present invention, as illustrated in FIG. 10, the monopole antenna 80 can be implemented using a frequency selective surface that is substantially transparent to enemy radar systems operating in certain known frequency bands. As illustrated in FIG. 10, the monopole antenna 80 includes: a cylindrical radiating surface 82 comprising a frequency selective surface; a conductive ground plane 84 which may, for example, be the outer metallic shell of the military vehicle; and a coaxial feed line 86 having an inner conductor 88 coupled to an end of the cylindrical radiating surface 82 and an outer conductor 90 coupled to the conductive ground plane 84. The cylindrical radiating surface 82 can include a dielectric core material (not shown) upon which the FSS is disposed.

Although the present invention has been described in conjunction with its preferred embodiment, it is to be understood that modifications and variations may be resorted to without departing from the spirit and scope of the invention as those skilled in the art readily understand. For example, the invention is not limited to the particular antenna applications disclosed above. Antennas in accordance with the present invention can be used in virtually any antenna application including use in, for example, identify friend or foe (IFF) systems, collision avoidance systems, direction finding (DF) systems, synthetic aperture radar (SAR) systems, etc. In one terrestrial application, for example, the present invention is used to increase the number of antennas that may be implemented on a single antenna tower. Relatively large licensing fees are generally charged for use of antenna towers and, therefore, it is advantageous to implement as many antennas on a single tower as possible. The present invention allows multiple antennas to be implemented in close proximity to one another on the antenna tower without much interference between antennas. Such modifications and variations are considered to be within the purview and scope of the invention and the appended claims.

What is claimed is:

1. An antenna system comprising:

a feed structure for coupling electromagnetic energy having a first frequency;

a first antenna element including a frequency selective surface portion that transmits said electromagnetic energy having said first frequency, that it receives from said feed structure, to free space and that receive said electromagnetic energy having said first frequency from free space and couples said received electromagnetic energy having said first frequency to said feed structure, with said frequency selective surface portion being predominantly transmissive to electromagnetic energy having a second frequency, said frequency selective surface portion comprising a number of elements including at least a first element having a body portion and a branch portion, said body portion including at least a first metalized segment, said first metalized segment used in defining a first space free of metalized segments, said first space having a length and a width with said first space length being greater than said first space width, said branch portion including at least a second metalized segment, said second metalized segment used in defining a second space free of metalized segments, said second space having a length and a width with said second space width being greater than said second space length, said first and second spaces defining a continuous path free of metalized segments;

a second antenna element that transmits and receives said electromagnetic energy having said second frequency, wherein said frequency selective surface portion of said first antenna element has a structural property that, when said second antenna element is located at different orientations relative to said first antenna element, said frequency selective surface portion remains predominantly transmissive to said electromagnetic energy having said second frequency; and an enclosure that houses each of said first and second antenna elements, said enclosure being transparent to each of said electromagnetic energy having said first and second frequencies, wherein each of said electromagnetic energy having said first and second frequencies passes through said enclosure, when said first and second antenna elements, respectively, transmit and receive said electromagnetic energy having said first and second frequencies.

2. The antenna system of claim 1, wherein:

said first antenna element is free of any ground plane and operates independently of any ground plane.

3. The antenna system of claim 1, wherein:

said feed structure includes a first section that has a frequency selective surface portion and a second section that is substantially free of any frequency selective surface portion, with said second section being farther from said frequency selective surface portion of said first antenna element than said first section is from said frequency selective surface portion of said first antenna element.

4. The antenna system of claim 1, wherein:

said enclosure includes a radome.

5. The antenna system of claim 1, wherein:

said second antenna is gimbaled for movement thereof.

* * * * *